US005484015A

United States Patent [19]

Kyees

[11] Patent Number: 5,484,015

[45] Date of Patent: Jan. 16, 1996

[54] COLD PLATE AND METHOD OF MAKING SAME

[76] Inventor: Melvin Kyees, 16732 Intrepid La., Huntington Beach, Calif. 92649

[21] Appl. No.: 160,815

[22] Filed: Dec. 3, 1993

[51] Int. Cl.[6] ..... F28F 3/12; F25D 3/02

[52] U.S. Cl. ..... 165/168; 62/396; 62/398

[58] Field of Search ..... 165/168; 62/390, 62/396, 398

[56] References Cited

U.S. PATENT DOCUMENTS

| | | | |
|---|---|---|---|
| 699,319 | 5/1902 | Henning | 62/398 |
| 2,663,551 | 12/1953 | Boling | 165/168 X |
| 2,828,948 | 4/1958 | Caldwell, Jr. et al. | 165/168 X |
| 3,011,323 | 12/1961 | Jaeges | 62/396 |
| 3,331,536 | 7/1967 | DeLorenzo | 62/398 X |
| 4,291,546 | 9/1981 | Rodth | 62/398 |
| 5,226,296 | 7/1993 | Kolvites et al. | 62/390 |

*Primary Examiner*—Allen J. Flanigan

*Attorney, Agent, or Firm*—George A. Maxwell

[57] ABSTRACT

An improved cold plate structure including a plurality of like horizontally disposed, elongate, sinuously formed liquid-conducting heat transfer tubing units of stainless steel tubing having laterally spaced elongate runner portions and recurvate end portions extending between related ends of adjacent runner portions; said units are arranged in vertical stacked relationship with each other; a plurality of tie bars tightly binding the units in stacked relationship with each other with their adjacent runner and end portions in tight substantially uniform heat-conducting contact with each other and having elongate horizontal upper and lower spacer portions extending transverse the stacked units in pressure bearing engagement therewith; a body of aluminum cast about the units and tie bars and defining a flat horizontal top icing surface that is tangential with upper edges of the upper spacer portions of the tie bars and a lower surface that is tangential with lower edges of the lower spacer portions of the tie bar; and, structure connected with each end of each tubing unit arranged within and projecting from the aluminum body to connect with related fluid handling apparatus.

13 Claims, 2 Drawing Sheets

COLD PLATE AND METHOD OF MAKING SAME

BACKGROUND OF THE INVENTION

In the art of chilling liquids, it has long been common practice to provide metal cold plates having flow passages extending through them to conduct liquids to be cooled. The cold plates have surfaces that are contacted by a cooling medium, such as ice, to cool the plates and thereby cool the liquids conducted through them.

Ordinary or conventional cold plates are characterized by bodies of cast aluminum having flat horizontal upwardly disposed top icing surfaces, horizontally disposed bottom surfaces, and vertical side and end surfaces about and between the top and bottom surfaces. The cold plates include one or more elongate liquid-conducting tubes that are arranged within and formed to extend throughout the horizontal planes of the plates. The tubes have inlet and outlet end portions that project freely outwardly from sides of the plates where they are conveniently accessible to effect connecting them with related liquid-handling equipment.

The liquid-conducting tubes conduct potable liquids and are commonly formed of stainless steel tube stock.

Cold plates of the class referred to above and here concerned with are ordinarily placed in the bottoms of thermally insulated ice cabinets or chests, with means to allow for connecting the free ends of the tubes with related fluid-handling apparatus and in which blocks or cubes of ice are deposited to engage the top icing surfaces of the plates. The plates are formed or are disposed within the cabinets or chests to suitably drain water (ice melt) so that the ice might best remain in contact with the plates and is not subject to floating in water above the plates.

The usual method of making cold plates of the class here concerned with includes; first, forming lengths of stainless steel tubing with inlet and outlet portions and with serpentine intermediate heat transfer portions that are to extend throughout the central portions of the cold plates of which they are to be a part; second, arranging the formed tubes within split molds (of cast steel or the like) having spaced front and rear walls to define the top icing surfaces and bottom surfaces of cold plates and having perimeter walls to define the perimeter surfaces of the plates (the molds have openings or ports therein through which the end portions of the tubes freely project); and finally, pouring molten aluminum into the molds to cast the desired aluminum body about the tubes and to form the cold plates.

After the newly cast cold plates and molds have cooled sufficiently, the molds are opened and the plates are removed therefrom in accordance with common practices. Subsequent to the foregoing, the newly cast cold plates are suitably cleaned and dressed as circumstances require.

In practice, it is desirable that the rate at which liquids to be chilled move into through and from the cold plates be slowed to assure ample time to effect desired heat transfer between the liquids and the aluminum bodies of the plates. It is also desired that the wall thickness of the heat transfer tubes be maintained as thin as is practical and that they present as much surface area between the aluminum and the liquid to be chilled as is practical. To the above end, it has become common practice to provide cold plates with elongate tubing units having elongate inlet and outlet tube sections at their opposite ends and pairs of elongate parallel, smaller in diameter, intermediate heat transfer tube sections extending between and suitably connected with the inlet and outlet tube sections. The ends of the pairs of heat transfer tube sections and their related inlet and outlet tube sections are typically connected together by means of female Y-couplings into which the related ends of the tube sections are slidably engaged. The tube stock from which the pairs of heat transfer tube sections are made is typically smaller in diameter and has a thinner wall thickness than the tube stock from which the inlet and outlet tube sections are made. However, the combined flow capacity and surface area of the two small diameter tube sections is greater than the flow capacity and surface area of the larger diameter and heavier tubing of which the end sections of the units are made. Thus, the flow of liquid through the central or intermediate portions of the tubing units is effectively slowed, the surface area thereof is increased and the wall thickness thereof is effectively minimized.

Next, it is common practice to make cold plates of the character referred to above so that they cool several different liquids. For example, cold plates are commonly provided for use in beverage dispensing apparatus that function to deliver several different flavors of chilled beverages. In such cases, the cold plates are provided with and include, several (two, three, four or more) liquid-conducting tubing units of the character described above. Each of the units in such plates is utilized to conduct and effect chilling of one flavor of beverage. In such plates, the several tubing units are alike and are stacked together, one atop the other, and, during manufacture, are positioned in molds so that they will occur between and in spaced relationship below and above the top icing surfaces and the bottom surfaces of the plates. The central heat transfer tubing sections of the adjacent tubing units in such plates would preferably be arranged in contact with each other to effect heat transfer between the tubes and the liquids flowing therethrough and thereby achieve substantial uniform chilling of the several liquid beverages. To relate adjacent tubing sections in such a manner has been sought to be attained by others in the past but they attained such poor results such efforts have not been pursued.

The wall thickness of the Y-couplings provided to connect the end tube sections to the pairs of intermediate tube sections of tubing units of the character referred to above is greater than the wall thickness of the tubing stock from which the tube sections of the units are established. The diametric extent of each tubing unit is greater where the Y-fittings occur and the thickness or vertical extent of a stack of like tubing unit is substantially greater where the stacked Y-coupling occur than where the stack small diameter heat transfer tubes occur.

The vertical extent or thickness of the plates must be sufficiently great to freely and adequately accommodate the thickest portions of the stacked tubing units, where the stacked Y-couplings occur and are of greater thickness than is necessary where the stacked central heat transfer tubes of the units occur. Accordingly, when multiplicities of stacked tubing units are arranged in molds, preparatory to pouring molten aluminum about them to establish cold plates; and the end portions of the stacked units are properly oriented and held in desired position within the molds, the intermediate portions of those stacked units are suspended freely in the molds and are free to move about therein. When molten aluminum (at 1400° F.) is poured into the molds and progressively flows into contact with the stacked tubing units, the thermal shock to which the stacked units are subjected causes the freely suspended portions of the tubes to expand, warp and twist in an erratic and uncontrollable manner.

As a result of the above-noted expanding, warping and twisting of tubes during pouring of the aluminum, the relative positioning of the tubing units within the finished cold plates is seldom, if ever, what the makers of the plates desire and is often what can be best described as a somewhat random array of tubing. As a result of such random array of tubing, the resulting cold plates are such that the spaces between and masses of aluminum about and between different parts of the tubing within the plates varies materially and randomly. As a result of the foregoing, the thermal conducting characteristics of such cold plates is neither uniform or predictable. One plate of a single production run of like plates might perform quite effectively and efficiently throughout its entire extent, while another might perform extremely ineffectively and inefficiently throughout its entire extent; while the performance of the remainder of the plates produced falls between those two extremes.

The prior art has long recognized that the heat exchange tubing in cold plates of the character here concerned with should not lie immediately adjacent to or become exposed at the top icing surfaces of the plates and have resorted to the use of various spacer devices and/or means to keep those tubes from moving too close to the walls of the molds that form the icing surfaces of the plates, during casting thereof. While those spacer means have served to prevent the tubes in such plates from being too close to the icing surfaces of the plates, they have not served to prevent the tubes from moving too far away from the walls of the molds that form the icing surfaces of the plates, during casting thereof, and have not worked to hold the adjacent portions of the heat transfer tubing sections of stacked tubing units in stacked engagement with each other. Accordingly, while the spacer means provided by the prior art prevent the heat conducting tube sections from moving too close to the icing surfaces of cold plates, they do not work to prevent those tube sections from moving too far from the icing surfaces and do not prevent thermal shocked-induced: movement of those tubes in any direction within the molds other than toward the icing surfaces forming walls of the molds. Thus, positioning of the heat transfer sections of stacked tubing units in prior art cold plates of the class here concerned with is somewhat random and is seldom, if ever, uniform.

The shortcomings and inconsistencies in the performance of cold plates provided by the prior art caused by displacement of the tubes therein as a result of thermal shock has become accepted in the art as an inherent shortcoming of such plates that cannot be overcome without considerable difficulty and an attending unacceptable increase in the costs exacted for such plates.

OBJECTS AND FEATURES OF MY INVENTION

It is an object and a feature of my invention to provide an improved cold plate structure including a cast aluminum body with a flat horizontal top icing surface and a flat lower surface spaced below the icing surface and a vertical stack of a plurality of like elongate sinuously formed steel heat exchange tubes in heat conducting contact with each other and positioned within the aluminum body to extend throughout the horizontal plane thereof with the upper-most and lower-most tubes of the vertically stacked tubes in limited predetermined and uniform spaced relationship below and above the top icing surface and the lower surface of the body (plate).

Another object and feature of the invention is to provide an improved cold plate structure of the general character referred to above that includes a plurality of elongate horizontal spacer rods that are equal in diametric extent with the predetermined space between the upper- and lower-most tubes and their related top icing surface and lower surface of the plate and that are positioned in lateral spaced parallel relationship from each other within the aluminum body in vertical pressure bearing engagement with the tubes engaged thereby.

It is yet another object and feature of my invention to provide a cold plate of the general character referred to above that includes a plurality of stacked tubing units with elongate sinuously formed horizontally disposed liquid conducting heat exchange tubing sections with straight parallel laterally spaced runner portions. and recurvate intermediate end portions extending between related ends of the runner portions and arranged in vertical stacked relationship with each other, a plurality of tie bars binding the tubing units in stacked relationship with adjacent portions of the heat-exchanging tube sections thereof in heat conducting pressure contact with each other, said tie bars having elongate horizontal upper and lower spacer portions extending transverse the top and bottom of the stacked heat-exchanging tube sections in spaced parallel relationship from each other and having vertical end portions extending between related ends of the upper and lower portions thereof; and, a body of aluminum cast about the stacked tubing units and the tie bars and defining a substantially flat horizontal upper icing surface that is substantially tangential with upper edges of the upper spacer portions of the tie bars and a flat horizontal lower surface that is substantial tangential with lower edges of the lower spacer portions of the tie bars.

It is an object and feature of the invention to provide a cold plate of the character referred to in which the tie bars are made of aluminum and fuse with the backing when it is cast.

Finally, it is an object and a feature of my invention to provide an improved cold plate of the general character referred to above wherein the several heat exchange tube sections of the tubing units have elongate ancillary end portions at their opposite ends; elongate inlet and outlet flow tube sections with inner and outer end portions; and couplings connecting the inner end portions of the inlet and outlet tube sections with the free ends of their related ancillary end portions of the heat exchange tube sections; the ancillary end portions of the heat exchange tube sections; the couplings and inner end portions of the inlet and outlet tube sections are within the body of aluminum and the outlet end portions of the inlet and outlet tube sections project freely from the body of aluminum.

The foregoing and other objects and features of my invention will be apparent and will be fully understood from the following description of my invention throughout which description reference is made to the accompanying drawings.

DETAILED DESCRIPTION OF THE INVENTION

Figure 1:
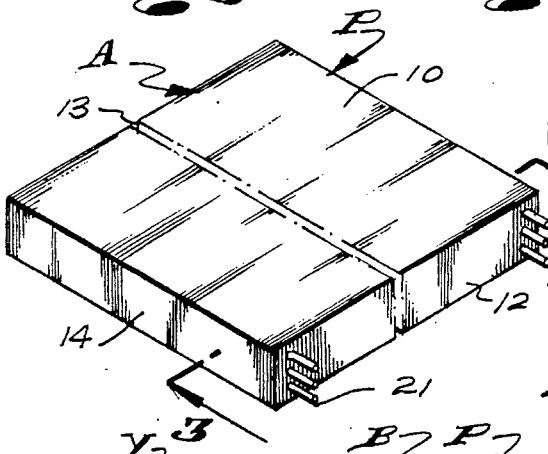
FIG. 1 is an isometric view showing the top, front and one side of a cold plate embodying my invention.
Figure 2:
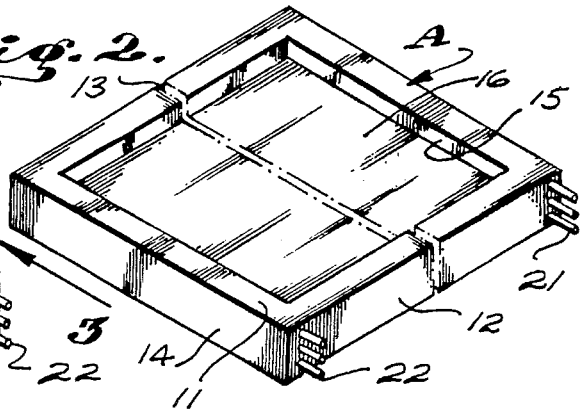
FIG. 2 is an isometric view showing the bottom, front and other side of the cold plate.

In the accompanying drawings, I have shown a typical cold plate P embodying my invention. For the purposes of this disclosure, the plate P is of common rectilinear form and is shown as including a body A of cast aluminum having a flat horizontal top icing surface 10, a horizontal bottom surface 11 and flat vertical front, rear and side surfaces 12, 13 and 14. The bottom surface 11 is formed with and is characterized by a downwardly opening recess 15 with a flat downwardly disposed horizontal top surface 16 that occurs on a horizontal plane spaced between the plane of the top icing surface and the bottom surface.

The plate P next includes an assembly or basket B of like elongate liquid conducting tubing units U positioned within the cast aluminum body A.

For the purpose of this disclosure, I have elected to show the basket B as including three units 0. In practice, the basket B might include but two units U or might include three, four or more units U, as desired or as circumstances require.

It is to be noted that the dimensions of the plate P can be varied to meet the needs and/or requirements of the user; and, if desired, the configuration of the plate can be altered to a substantial extent, to meet special needs, without departing from the broader aspects and spirit of my invention.

Figure 3:
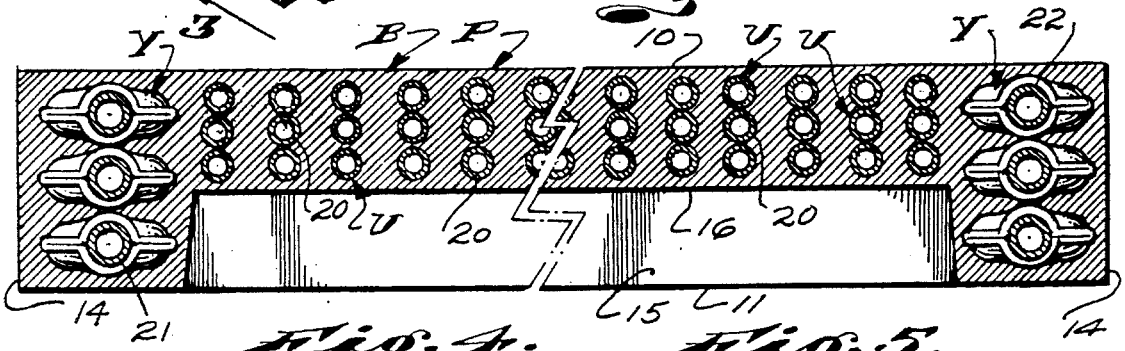
FIG. 3 is an enlarged cross-sectional view taken substantially as indicated by Line 3—3 on FIG. 1.
Figure 4:
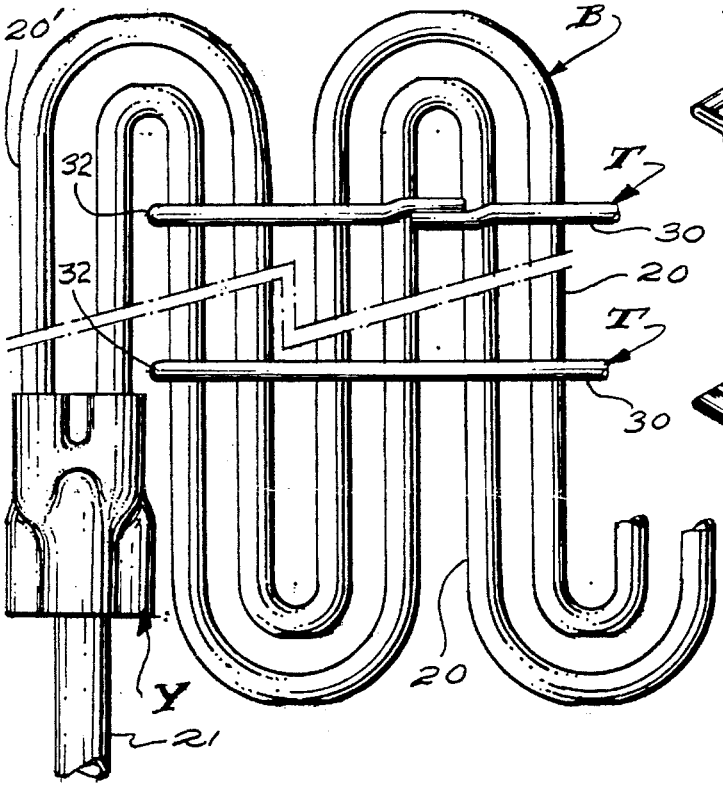
FIG. 4 is an enlarged plan view of one of two like end portions of a tubing assembly and taken substantially as indicated by Line 2—2 on FIG. 3.
Figure 7:
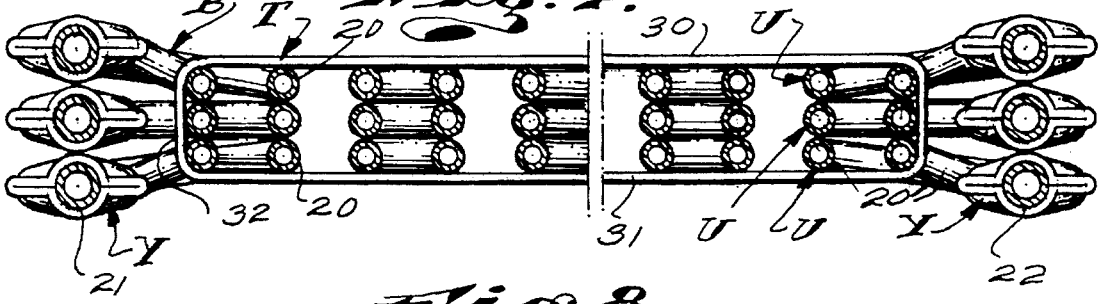
FIG. 7 is cross-sectional view of a tube assembly in preassembled configuration.

Each of the like tubing units U includes a pair of elongate horizontally disposed, sinuously formed, laterally spaced, parallel fluid-conducting heat transfer tubes 20, elongate inlet and outlet tubes 21 and 22, with inner and outer end portions, at opposite ends of the tubes 20 and female Y-couplings C connecting the inner end portions of the tubes 21 and 22 with their related ends of their related pairs of tubes 20, as clearly shown in FIGS. 3, 4 and 7 of the drawings.

Figure 5:
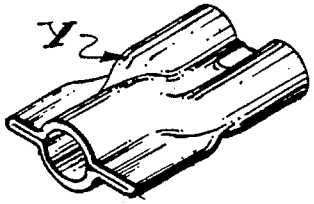
FIGS. 5 and 6 are isometric views showing opposite ends of a Y-coupling.
Figure 6:
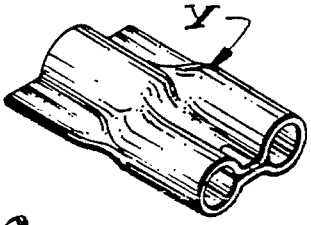

The Y-couplings C can vary widely in form and construction. For the purpose of this disclosure and as best shown in FIGS. 5 and 6 of the drawings, the couplings C are formed from metal tube stock. Since the couplings C and their related portions of the tubes 20, 21 and 22 are within the cast aluminum body A of the plate. No leakage of liquid can occur at and about the coupling where they connect with the tubes, so making use of formed metal couplings illustrated is preferred. Those couplings are less costly than other forms of Y-couplings and are better able to withstand the thermal shock to which the couplings are subjected to when the aluminum body A of the plate is cast about them.

The several tubes 20, 21 and 22 and the couplings C are preferably established of stainless steel. It is to be noted that the stainless steel of which the tubes and couplings are established has an index of heat conductivity that is notably less than the index of heat conductivity of the aluminum of which the body A of the plate is made.

The combined effective cross-section or flow capacity of the pair of tubes 20 of each tubing unit U is greater than the effective cross-section or flow capacity of the tubes 21 and 22 of that unit. Accordingly, the rate of flow of liquid flowing through the inlet tube 21 and into and through the heat conducting tubes 20 slows as it flows therethrough, and reestablishes its normal flow rate as it enters the outlet tube 22, thus notably increasing the heat transfer time between the liquid in the tubes 20 and the aluminum body A, during operation and use of the plate P.

For effective and efficient operation of the plate P, it is desirable to maintain the wall thickness of the tubes 20 as thin as possible so that as little stainless steel as is practical occurs between the liquid flowing through the tubes 20 and the aluminum body A of the plate. Thus, the tendency for the stainless steel of which the tubes 20 is made to slow the transfer of heat between the liquid and the aluminum body is maintained at a minimum.

In accordance with the above, the tubes 20 are made of tube stock that is smaller in diameter and that has a thinner wall thickness than the tube stock from which the tubes 21 and 22 are made. Thus, while the combined effective cross-section of the pair of tubes 20 is greater than the effective cross-section of the tubes 21 and 22, to effect slowing of the rate of flow of liquid through the tubes 20, the wall thickness of the tubes 20 is notably less than that of the tubes 21 and 22 so that the slowing of heat transferred through the walls of the tubes 20 is maintained at a minimum.

In practice and as shown, the tubes 20 are formed with elongate laterally spaced parallel runner portions with front and rear ends and recurvate intermediate end portions extending between and connecting related ends of the runner portions to establish the desired sinuate configuration. When forming the recurvate end portions of the tubes, the recurvate portions tend to collapse slightly and reduce the effective cross-sectional area of those portions of the tubes. Accordingly, the size or diameter of the pair of tubes 20 is such that the combined effective cross-sectional area of the pairs of tubes, at their slightly collapsed recurvate end portions, is at least equal to the effective cross-section of the tubes 20 and 22, so that the rate of flow of liquid into and out of the plate P is the same.

The several like tubing units U are arranged in vertical stacked relationship with each other and are bound or tied together to establish the basket B; with the pairs of tubes 20 of adjacent units U in substantial uniform bearing and heat conducting contact with each other, as clearly shown in the drawings.

The related pairs of like tubes 20 are bound together by means of a plurality (two or more) of tie bars T. The tie bars T are established of round wire or bar stock and have horizontal upper and lower or top and bottom portions 30 and 31 that extend laterally across the top and bottom of the stacked tubing units U in engagement with the straight, parallel, laterally spaced runner portions of the tubes 20 of the upper and lower tubing units U; and have vertical end portions 32 that extend between the related ends of the portions 31 and 32 and that occur laterally outward of and engage related series of vertically stacked runner portions of the tubes 20 at the opposite sides of the basket B, as clearly shown in FIGS. 7 and 9 of the drawings.

The tie bars T are preferably established of a single length of wire or rod stock bent to extend about the several tubes 20 engaged thereby and have end portions that are suitably fixed together, as by resistance welding, to form what is, in effect, a continuous ring. Thus, the tie bars T secure the units U together as an integrated assembly or basket.

The top and bottom portions 30 and 31 of the tie rods serve as or are spacers that function to keep and set the top and bottom pairs of tubes 20 in predetermined uniform spaced relationship from the top surface 10 and the lower surface 16 of the plate P as will hereinafter be described.

In practice, and as shown in the drawings, the two lateral outside runner portions 20' and related recurvate end portions of the pairs of tubes 20 of each unit U are connector portions or the units U that extend between and connect their related couplers C with the next or second runner portions of the tubes 20 that occur at the opposite sides of the stacked and bound-together portions of the tubes 20. The pairs of connector portions 20' of the stacked units U are not in bearing engagement with each other and are but ancillary connector portions of the tubes 20.

In accordance with the foregoing and as shown in the drawings, the end portions 32 of the tie bars are to be viewed as occurring outward of and engaging the outer most or side runner portions of the stacked pairs of tubes 20 (not the ancillary connector portions 20' thereof).

It is to be noted that the vertical extent or depth of the basket B of bound units U throughout the portion of the basket B where the pairs of tubes 20 are stacked is notably less (about one-half) the vertical extent or depth of the basket where the stacked couplers C occur.

When the basket B is prepared to have the body A of aluminum poured about it, as shown in FIG. 7 of the drawings, the top of the stack of tubes 20 and the upper spacer portions 30 of the tie bars T are on planes spaced well below the upper or top plane of the basket B on which the top of the stacked couplers C occur; and, the bottom of the stack of tubes 20 and the lower spacer portion 31 of the tie bar T are spaced well above the lower or bottom plane of the basket on which the bottoms of the stacked couplers C occur.

If, as practiced by the prior art, the basket B, as shown in FIG. 7 of the drawings, was placed in a mold that freely accommodates the whole of the basket and molten aluminum was poured into the mold to establish a cold plate having flat top and bottom surfaces; the mold would have to be of sufficient vertical extent or depth to accommodate the stacked couplings C. In such a case, the stacked tubes 20, prior to pouring the aluminum, would be spaced from the top and bottom walls of the mold excessive distances to establish a cold plate having effective heat transfer characteristics. Further, and more important, when the molten aluminum (at 1400° F.) is poured into the mold and about the basket, the thermal shock to which the stainless steel tubes 20 and their ancillary end portions 20' would be subjected would cause different parts and/or portions of the tubes to warp and twist in an uncontrollable manner as the mold is filled. Those parts and portions of the tubes warp and twist to such an extent that they displace and distort the tie bars T and they move up and down and laterally in such a manner that portions of the tubes 20 move out of engagement and away from each other. They move toward and away from the top and bottom walls of the mold and within the body of aluminum. As a result of the foregoing, the tubes 20 are in sufficient disarray so that resulting cold plate is highly not likely to function in an effective and efficient manner.

Figure 8:
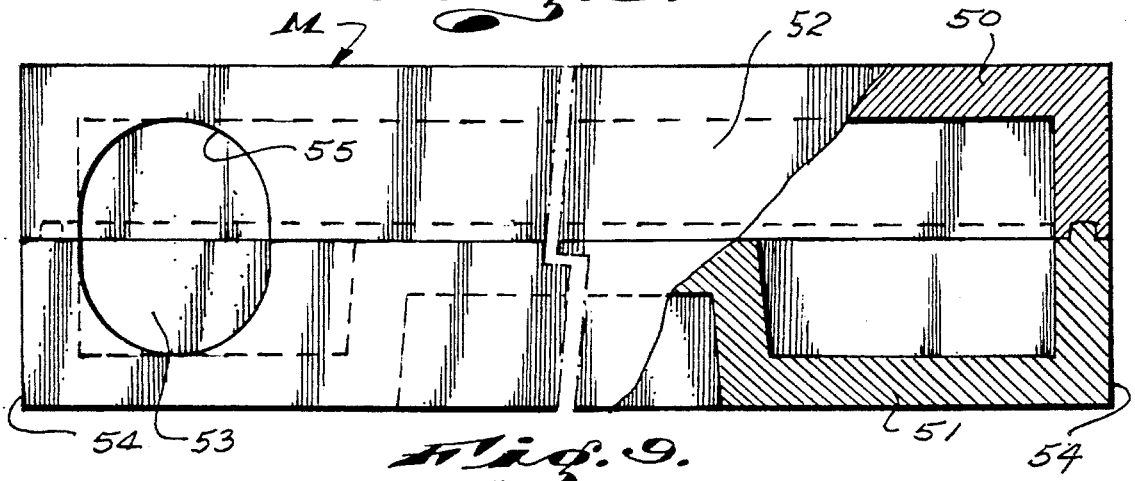
FIG. 8 is a top view of a plate mold with one-half being shown in elevation and the other half in cross-section.
Figure 9:
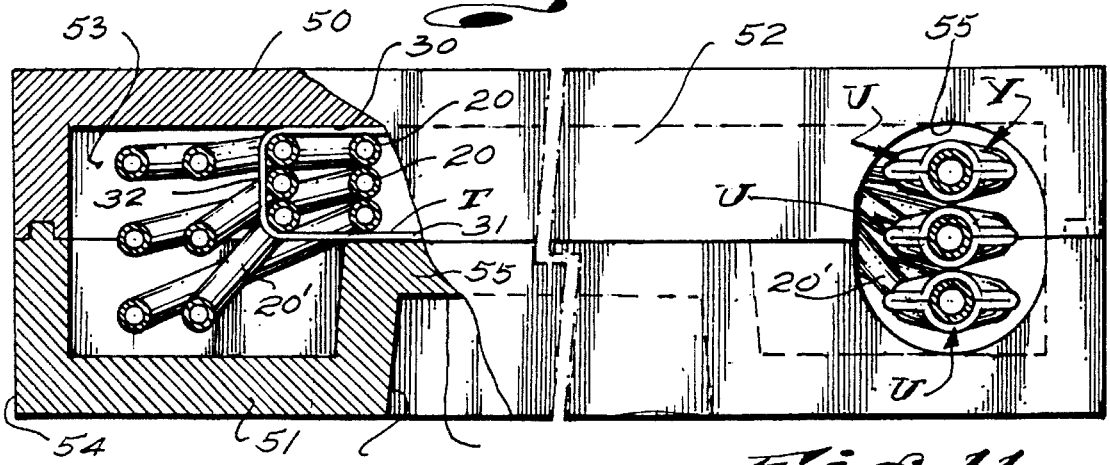
FIG. 9 is a top view of the plate mold positioned therein, with one-half being shown in cross-section and the other half being shown in elevation and showing the tubing assembly.

In furtherance of my invention and to prevent the tubes 20 from becoming displaced as a result of thermal shock; when the body of aluminum is cast about them to establish the cold plate P, I provide a two-piece split mold M such as shown in FIGS. 8 and 9 of the drawings.

The mold M is a two-piece box-like mold of steel. It has a flat top wall 50 to form the top icing surface 10 of the plate P, a bottom wall 51 spaced from the top wall to form the bottom surface 11 of the plate P, front and rear walls 52 and 53 to form the front and rear surfaces of the plate P, and side walls 54 to establish the side surfaces of the plate P. The front wall 52 is formed with spaced openings or ports 55 to freely accommodate the forward portions of the inlet and outlet tubes 21 and 22 of the tubing units U of the basket B and through which molten aluminum can be conveniently poured.

The mold is split centrally of its front, rear and side walls and intermediate its top and bottom walls, to enable it to be opened to release the casted plate, in accordance with common practices, The major interior depth or vertical extent of the mold is sufficiently greater than the depth or vertical extent of the basket B at the couplings C so that sufficient space is afforded between the walls 50 and 51 and the basket B to assure complete encapsulation of the end portions of the stacked units U, where the couplings C occur, within the aluminum body A of the plate P. The bottom wall 52 of the mold M is provided with or is formed with a central upwardly projecting core portion 55 with a flat top surface 56 to establish the recess 15 and lower surface 16 on the body A of the plate P. The top surface 56 of the core 55 of the mold M is spaced below the top wall 50 of the mold a distance equal to the thickness or vertical extent of the stack tubes 20 plus the spacer portions 30 and 31 of the tie bars T. The plan configuration of the core portion 55 of the mold and the plan configuration of the whole of the stacked tubes 20 of the basket B are substantially the same.

When it is desired to cast the body A of the cold plate P about the basket B, the basket B is arranged in the bottom half of the mold M and the top half of the mold is then placed over the basket B and the bottom half of the mold. The two halves of the mold are suitably secured together. When the basket B is within the mold, as noted above, the stacked and bound-together tubes 20 thereof are yieldingly moved upwardly relative to the end portions of the basket, as shown in FIG. 9 of the drawings.

When the basket is within the mold M, the forward portions of the tubes 21 and 22 project freely through the openings 55 and freely from the front wall of the mold where they can be manually engaged and manipulated as circumstances might require.

When the mold is closed and the basket is positioned therein, as shown in FIG. 9 of the drawings, the top wall 50 and top surface 56 of the core 55 of the mold establish pressure engagement with the spacer portions 30 and 31 of the tie bars T to firmly hold the stacked tubes 20 in substantial uniform stacked engagement with each other. The force with which the above-noted parts are clamped within the mold is sufficient to normally inhibit the tubes 20 from moving relative to each other and within the mold when subjected to thermal shock as the aluminum body B is cast, but not so great as to crush or otherwise damage the tubes 20.

When the basket B is engaged in the mold, as noted above, the mold is turned to dispose its front wall and openings upwardly and molten aluminum is poured through the openings to fill the mold and cast the aluminum body A about the basket, with the tubes 21 and 22 projecting freely therefrom.

After the mold and newly cast plate P has been allowed to cool sufficiently, the mold M is opened and the newly cast plate P is removed therefrom. The newly cast plate P requires minor dressing to put it into finished form.

When casting the aluminum body A of the plate P about the basket B, all adjacent elements and/or parts of the basket B are effectively brazed together by the molten aluminum, including the connections between the couplings C and their related ends of the various tubes.

Figure 11:
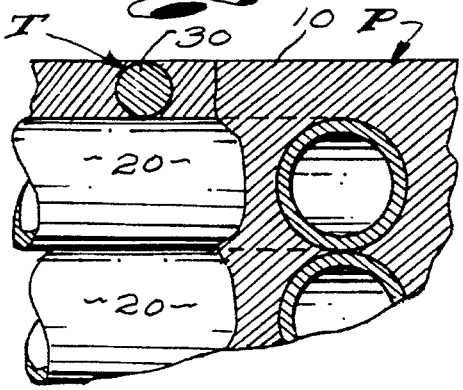
FIG. 11 is an enlarged sectional view of a portion of the cold plate structure.

It is to be noted that the round wire stock that establishes the tie bars and the round tube stock that establishes the tubes 20, 21 and 22 is such that the molten aluminum flows completely about the parts to fully encapsulate and braze them together, as shown in FIG. 11 of the drawings.

Figure 10:
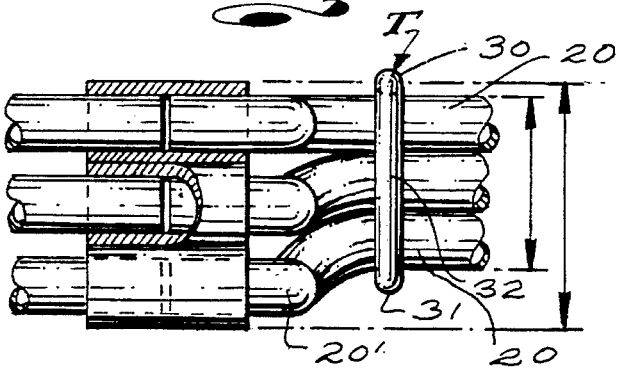
FIG. 10 is an illustration of another form of coupling means.

In FIG. 10 of the drawings, I have shown a portion of a basket B' comprising a stack of tubing units U' wherein the tubes 20' and 21" are shown as being the same in diameter and the couplings C' are simple straight nipples formed of tube stock that is larger in diameter and has a greater wall thickness than the stock from which the tubes are established. The tubes 20' are shown bound in stacked engagement by a tie bar T'; in accordance with my invention.

It will be apparent that the vertical extent of the basket B' where the tubes 20" occur is notably less than the vertical extent of the basket where the couplings C' occur. Accordingly, when casting a cold plate body about the basket B', the same kind of special mold and the same basic molding procedure must be used if the stacked tubes 20" are to be in predetermined uniform spaced relationship from the top and bottom surfaces of the resulting cold plate and if the tubes 20" are to be in uniform bearing and heat conducting contact with each other within the cold plate.

In the form of mold M that I elected to illustrate, the core portion to establish the recess 15 lower surface 16 of the cold plate P is formed integrally with its related half of the mold and has a wall thickness that is equal to the wall thickness of all other portions of the mold, in accordance with old and established practices. In practice, I have produced my new and improved cold plate structure in molds wherein the core to establish the surface 13 of the plates is a separate part, in the nature of an insert, arranged and suitably secured in its related half of the mold. While this practice is not ideal, in producing long runs of cold plates, it is quite satisfactory in producing short runs of cold plates.

In practice, the runner portions of the ancillary portions 20' of the tubes 20 and the tubes 21 and 22 can be cut to different lengths so that the couplings C at each end of the stacked units U do not occur in stacked relationship with each other and thereby reduce the difference in vertical extent between the central and end portions of the stacked units U. While such practices work to reduce the noted differences in vertical extent between the central and end portions of the baskets, it does not eliminate or reduce those differences sufficiently to overcome the above-noted problems such differences create. Further, to follow such practices requires that each of the units U establishing a basket B must be specially made and is different from each of the other units U thereby notably complicating manufacture and assembly of the baskets and adding to the cost of the cold plates.

In practice, it is necessary that the forward ends of the inlet and outlet tubes 21 and 22 project freely forwardly and/or outwardly from the front of the plate P to enable liquid handling hoses and the like to be easily and conveniently connected therewith. In many instances, to assure the presence of sufficient space between the vertically spaced forward end portions of the tubes 21 and of the tubes 22, it is necessary that the forward ends of those tubes be held apart in suitable and desired spaced relationships from each other as the body A of the plate P is cast. As a result of the foregoing, in those instances where the tubes 21 and 22 must be spread apart, as noted above, the ancillary portions 20' of the tubes 20, the couplings C and the tubes 21 and 22 cannot be bound together in stacked relationship with each other as the tubes 20 are bound together.

In practice, the end portions 32 of the tie bars T can be extended and formed as shown in dotted lines in FIG. 9 of the drawings to pre-position the end portions of the units U relative to the central portion thereof and to prevent the ancillary end portions 20' of the tubes from becoming adversely displaced, without departing from the broader aspects and spirit of my invention.

In practice, I have made the tie bars T of ⅛" round wire stock with the result that the upper-most and lower-most tubes 20 of the stacked units U are uniformly spaced ⅛" below and above the top icing surface 10 and lower surface 13 of the finished cold plate P. With the above relationship of parts, the body A of aluminum is of minimum depth or vertical extent, throughout its major central portion, and such that insufficient shrinkage of the aluminum occurs to be readily discernible or such that the top surface of the plate might require dressing to attain a well finished and merchantable cold plate structure.

In my new cold plate structure P, the adjacent portions of the stacked tubes 20 are maintained in close heat transferring relationship with each other so that no appreciable aluminum and a minimum amount of stainless steel occurs between the liquids conducted through adjacent tubes 20 and so that the heat transfer time between the liquids flowing through adjacent tubes is maintained at a minimum. As a result of the foregoing, sufficient heat exchange is let to occur between the liquids flowing through the several adjacent tubes 20 to work to balance the temperature thereof and so that the chill temperature of the several liquids is at or very near the same temperature. That is, the temperature of one liquid is not appreciably different from the temperature of each of the other liquids, as is often the case in cold plates of the character here concerned with wherein the heat transfer tubes for the several liquids are not in sufficient uniform heat conducting contact with each other.

In practice and as shown in FIG. 3 of the drawings, the downwardly opening recess or cavity in the plate P can be filled with a suitable thermal insulating material 60. The insulation 60 shields the central portion of the plate P from radiant heat and prevents it from absorbing heat from the atmosphere and that structure above which the cold plate is positioned when in use.

Finally, in the preferred carrying out of my invention, the tie bars are made of aluminum and are such that when the body of aluminum is cast about them, they fuse into and with the body to become an integrated part thereof. While their presence in the body can be found to exist by careful study of the finished cold plate, their presence is otherwise non-detectable.

In some instances, the tie bars must be made of steel. In those instances, during casting of the plate the molten aluminum is apt not to fully encapsulate the tie bars and air gaps are likely to form about them. Further, due to the difference in the thermal expansion and contraction of steel and aluminum, there is a tendency for steel bars to separate from the aluminum body during regular and intended use of the cold plate. Due to the fact that steel has a lower coefficient of sheet conductivity than aluminum, when steel tie bars are used, the bars present lines throughout the icing surface of the plate where heat transfer is slow. Due to the difference in hardness of steel and aluminum, the use of steel tie bars tends to complicate and make dressing all the icing surface of the cold plate more difficult. Finally, when steel tie bars are used, their presence is noticeable and the finished cold plate does not appear as neat and clean as do cold plates in which aluminum tie bars are used.

In accordance with the above, while the tie bars can be made of steel without departing from the broader aspects of my invention, making the tie bars of aluminum affords notable advantages and is recommended whenever circumstances permit the use of aluminum.

The Coca-Cola Company conducts comparative tests of all commercially available cold plates that are suitable for chilling beverages in that company's beverage dispensing machines and/or apparatus in which cold plates are used. The Coca-Cola Company's tests seek to determine how many standard 12-oz. servings of beverages conducted through and chilled within a cold plate to, for example, 35° F., can be dispensed in one minute without a rise in temperature of the dispensed beverages. In those tests, the cold plates produced in accordance with the teachings of the prior art have been found to be capable of dispensing from 8 to 12, or an average of 10, 12-oz. servings of beverage in one minute before an unacceptable rise in temperature of the beverages conducted therethrough is detected. The Coca-Cola Company's testing of my new cold plate determined that fifteen 12-oz. servings of beverage, chilled to 35° F., can be dispensed from it, in one minute, without detection of an unacceptable rise in temperature. Accordingly, the efficiency of my new cold plate is approximately 30% greater than the efficiency of those cold plates provided by the prior art. Of greater importance, the efficiency and operating characteristics of my new cold plate are uniform and predictable, thus enabling more accurate and dependable management of beverage dispensing machines and apparatus in which my cold plate is used.

Another notable advantage attained in practicing my invention resides in the fact that less aluminum is required to be used in establishing the aluminum body (due to the recess 15 formed therein) and the cold plate therefore is less costly to make and is lighter than comparable cold plates provided by the prior art.

Having described only typical preferred forms and embodiments of my invention, I do not wish to be limited to the specific details herein set forth but wish to reserve to myself any modifications and/or variations that might appear to those skilled in the art and which fall within the scope of the following claims.

HAVING DESCRIBED MY INVENTION, I CLAIM:

1. A cold plate including a cast aluminum body having vertically spaced horizontal top and lower surfaces and vertical outside surfaces about and between the perimeters of the top and lower surfaces; a plurality of like vertically stacked tubing units each including elongate inlet and outlet tubes with inner and outer end portions, an elongate horizontal sinuously formed heat transfer tube with inlet and outlet ends; couplings connecting the inlet and outlet ends of the heat transfer tube with the inner end portions of the inlet and outlet tubes; a plurality of spaced tie bars engaged with the stacked heat transfer tubes and having elongate upper and lower spacer portions extending transversely across and in vertical pressure engagement with the upper-most and lower-most heat transfer tubes and holding those tubes in substantial uniform pressure bearing and heat transfer engagement with each other; said plurality of like vertically stacked tubing units are positioned within the aluminum body with the outer end portions of the inlet and outlet tubes projecting freely outwardly therefrom and with the top and lower surfaces of the body on planes that are coincidental with the planes on which the upper and lower edges of the upper and lower spacer portions of the tie bars occur.

2. The cold plate set forth in claim 1 wherein the heat transfer tubes that are sinuously formed include a plurality of elongate, laterally spaced, parallel runner portions with front and rear ends and recurvate end portions extending between related ends of adjacent runner portions and ancillary end portions at opposite ends of the heat transfer tubes that extend to and connect with related couplings.

3. The cold plate set forth in claim 1 wherein the heat transfer tubes that are sinuously formed include a plurality of elongate, laterally spaced, parallel runner portions with front and rear ends and recurvate end portions extending between related ends of adjacent runner portions and ancillary end portions at opposite ends of the heat transfer tubes and extending to and connected with related couplings; the tie bars are spaced apart between the front and rear ends of and extend transversely of the runner portions of the upper and lower heat transfer tubes.

4. The cold plate set forth in claim 1 wherein the vertical extent of the stacked tubing units where the couplings occur is greater than the vertical extent of the stacked tubing units where the heat transfer tubes and spacer portions of the tie bars occur; the body has outer portions within which the stacked coupling portions of the tubing units are positioned and that define a bottom surface on a plane that is spaced below the lower surface of the body.

5. The cold plate set forth in claim 4 wherein the heat transfer tubes are sinuously formed and include a plurality of elongate, laterally spaced, parallel runner portions with front and rear ends and recurvate end portions extending between related ends of adjacent runner portions and ancillary end portions at opposite ends of the heat transfer tubes that extend to and connect with related couplings.

6. The cold plate set forth in claim 1 wherein the heat transfer tubes are sinuously formed and include a plurality of elongate, laterally spaced, parallel runner portions with front and rear ends and recurvate end portions extending between related ends of adjacent runner portions and ancillary end portions at opposite ends of the heat transfer tubes that extend to and connect with related couplings; the tie bars are spaced apart between the front and rear ends of and extend transversely of the runner portions of the upper and lower heat transfer tubes.

7. A cold plate including a cast aluminum body having vertically spaced horizontal top and lower surfaces and vertical outside surfaces between and about the perimeters of the top and lower surfaces; a plurality of like vertically stacked tubing units each including elongate inlet and outlet tubes with inner and outer end portions, a plurality of elongate laterally spaced parallel horizontally disposed sinuously formed heat transfer tubes with inlet and outlet ends; couplings engaged with and between the inlet ends of the pair of heat transfer tubes and the inner end portions of the inlet and outlet tubes; a plurality of tie bars securely engaged about the stacked heat transfer tubes and having elongate upper and lower spacer portions extending transversely across and in vertical pressure engagement with the uppermost and lower-most stacked heat transfer tubes and holding adjacent portions of those tubes in pressure and heat transferring engagement with each other; said plurality of like vertically stacked tubing units are positioned within the aluminum body with the outer end portions of the inlet and outlet tubes projecting freely outwardly therefrom and with the top and lower surfaces of the body on planes that are coincidental with the planes on which upper and lower edges of the upper and lower spacer portions of the tie bars occur.

8. The cold plate set forth in claim 7 wherein the sinuously formed heat transfer tubes of each tubing unit includes a plurality of elongate laterally spaced parallel runner portions with front and rear ends and recurvate end portions extending between related ends of adjacent runner portions and ancillary end portions at opposite ends of the heat transfer tubes and extending to and connected with related couplings.

9. The cold plate set forth in claim 7 wherein the sinuously formed heat transfer tubes of each tubing unit includes a plurality of elongate laterally spaced runner portions with front and rear ends and recurvate end portions extending between related ends of adjacent runner portions and ancillary end portions at opposite ends of the heat transfer tubes that extend to and connect with related couplings; the tie bars are spaced apart between the front and rear ends of and extend transversely of the runner portions of the uppermost and lower units of heat transfer tubes.

10. The cold plate set forth in claim 7 wherein the vertical extent of the stacked tubing units where the couplings occur is greater than the vertical extent of the stacked tubing units where the heat transfer tubes and spacer portions of the tie bars occur; the body has outer portions within which the stacked couplings ancillary portions of the tubing units are positioned and that define a bottom surface on a plane that is spaced below the lower surface of the body.

11. The cold plate set forth in claim 10 wherein the sinuously formed heat transfer tubes of each tubing unit includes a plurality of elongate runner portions with front and rear ends and recurvate end portions extending between related ends of adjacent runner portions and ancillary end portions at opposite ends of the heat transfer tubes and extending to and connected with related couplings.

12. The cold plate set forth in claim 9 wherein the body is cast about the stacked tubing units and the tie bars are made of aluminum and are fused in the body.

13. The cold plate set forth in claim 7 wherein the body is cast about the stacked tubing units and the tie bars are made of aluminum and are fused in the body.

* * * * *